US007172035B2

(12) United States Patent
Michael et al.

(10) Patent No.: US 7,172,035 B2
(45) **Date of Patent: *Feb. 6, 2007**

(54) SONDE HOUSING AND METHOD OF MANUFACTURE

(75) Inventors: Tod Michael, Chariton, IA (US); Ric Smith, Otley, IA (US); Mark Facile, Pella, IA (US)

(73) Assignee: Vermeer Manufacturing Company, Pella, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/277,437

(22) Filed: Mar. 24, 2006

(65) Prior Publication Data

US 2006/0151213 A1 Jul. 13, 2006

Related U.S. Application Data

(63) Continuation of application No. 11/112,110, filed on Apr. 22, 2005, which is a continuation of application No. 10/047,422, filed on Jan. 14, 2002, now Pat. No. 7,036,609.

(51) Int. Cl.
*E21B 47/00* (2006.01)

(52) U.S. Cl. ..... 175/19; 175/320

(58) Field of Classification Search ..... 175/19, 175/73, 320

See application file for complete search history.

(56) References Cited

U.S. PATENT DOCUMENTS

| | | | | |
|---|---|---|---|---|
| 3,746,106 | A | 7/1973 | McCullough et al. | |
| 4,858,704 | A | 8/1989 | McDonald et al. | |
| 5,253,721 | A | 10/1993 | Lee | |
| 5,633,589 | A | 5/1997 | Mercer | |
| 5,799,740 | A | 9/1998 | Stephenson et al. | |
| 5,899,283 | A | 5/1999 | Cox | |
| 6,148,935 | A | 11/2000 | Wentworth et al. | |
| 6,260,634 | B1 | 7/2001 | Wentworth et al. | |
| 6,371,223 | B2 | 4/2002 | Wentworth et al. | |
| 6,470,979 | B1 | 10/2002 | Wentworth et al. | |
| 6,606,032 | B1 | 8/2003 | Fling | |
| 6,644,421 | B1 * | 11/2003 | Long | 175/40 |
| 6,749,030 | B2 | 6/2004 | Blair et al. | |
| 7,036,609 | B2 * | 5/2006 | Michael et al. | 175/19 |
| 2001/0017222 | A1 * | 8/2001 | Wentworth et al. | 175/19 |
| 2002/0060095 | A1 * | 5/2002 | Wentworth et al. | 175/73 |

FOREIGN PATENT DOCUMENTS

| | | |
|---|---|---|
| WO | WO 01/49965 A1 | 7/2001 |

* cited by examiner

*Primary Examiner*—William Neuder
(74) *Attorney, Agent, or Firm*—Merchant & Gould P.C.

(57) ABSTRACT

A sonde (transmitter) housing having a one-piece design for improved housing rigidity. The housing includes a mechanically-adjustable mounting configuration adaptable to a variety of sonde applications. A method of making the sonde housing in a one-piece design and infinitely orienting the sonde clocking electronics.

17 Claims, 23 Drawing Sheets

SONDE HOUSING AND METHOD OF MANUFACTURE

CROSS-REFERENCE TO RELATED APPLICATIONS

This application is a continuation of application Ser. No. 11/112,110, filed Apr. 22, 2005; which is a continuation of application Ser. No. 10/047,422, filed Jan. 14, 2002; now U.S. Pat. No. 7,036,609 which applications are incorporated herein by reference.

TECHNICAL FIELD

The principles disclosed relate to an enhanced sonde housing and method of manufacture. More particularly, this disclosure concerns a sonde housing constructed for use in a variety of applications and method of making such housing.

BACKGROUND

Horizontal directional drilling is a process commonly utilized to create boreholes for the installation of utilities underground. The process involves a drilling machine, a drill string and a drill head. The drill string is typically composed of individual sections of hollow drill rod, and is attached above ground between the drilling machine and the drill head. The drilling machine is typically capable of rotating and longitudinally propelling and thrusting the drill string, while simultaneously pumping a fluid through the drill string. The drill head is typically composed of an adapter assembly and a drill bit. There are many types of adapter assemblies, including static and dynamic, each typically connecting on one end to the drill string, and on the other end to the drill bit. There are a variety of drill bits, each designed to be used in conjunction with a specific type of adapter.

The process starts with installing the drill head onto a single drill rod above ground. The drill rod is then connected, at the opposite end, to a drilling machine. The drilling machine then rotates and pushes the drill rod and drill head into the ground. At the same time, a fluid is pumped through the drill rod and typically directed to the cutting surface of the drill bit to assist in cutting the ground material.

The pumped fluid has a variety of purposes. One primary purpose relates to removal of material to create the borehole. In this application, fluid transports cuttings created by the drill bit back along the bored hole and out to the ground surface. In most setups, a particular drill bit is configured to cut a hole larger than the drill rod diameter by disturbing the soil formation as it is rotated. Examples of such bits can be found in U.S. Pat. Nos. 5,799,740 and 5,899,283. At the same time, a water-based fluid is pumped through the drill string and through the bit to thoroughly mix with the disturbed soil, creating a slurry. The slurry then follows the path of least resistance, which is typically back along the drill string, and exits at the point the drill string enters the ground. In this application the adapter assembly is static, simply adapting from the drill rod threaded connection, which is smaller diameter, to the drill bit, which is larger in diameter to cut the larger hole required for the proper transfer of cuttings.

In some other applications there is no requirement to transport the cuttings and the ground is simply compacted, forming a borehole without any material removal. Impact or hammering load on the drill bit increases the productivity of drilling. For this type of application, the adapter assembly includes a dynamic component, typically a pneumatic hammer, in addition to a static adapting element. (An example disclosed in U.S. Pat. No. 4,858,704.) The fluid being pumped in the drill string is compressed air that transfers power to actuate the pneumatic hammer. The path of fluid flow includes the drill string, the static component of the adapter assembly, and the hammer.

In yet other applications, typically highly compressed soils and or rock, a similar setup utilizing a down hole hammer can be used in conjunction with a different drill bit to create cuttings for transport. The hammers can be pneumatic hammers or water hammers. The drill bits are designed primarily to fracture the soil or rock formation by the impact loading received from the hammer. Once the formation is fractured, the cuttings need to be transported away from the cutting face.

Transportation of the cuttings is aided by rotation of the drill bit and drill string, along with the resulting flow of the fluid. The fluid is typically air or a mixture of air and a water based fluid or other suspension material which functions to aid the air's ability to transport the cuttings. In this type of application, the fluid is utilized to transfer power to actuate a hammer to transport cuttings. The path of fluid flow includes the drill string, adapter assembly and drill bit.

In still another arrangement involving cutting highly compressed soils or rock, the drill bit is adapted to rotate. One such design includes the use of a mud motor capable of converting fluid power (from the pumped fluid) into rotational power to rotate the drill bit. In this type of application, the adapter assembly includes a dynamic component, the mud motor, along with the previously described static element. The fluid is typically water based. The path of fluid flow includes the drill string, the adapter assembly and the drill bit.

In all these applications, the transfer of fluid assists in the efficient functioning of the drill bit and/or transportation of the cuttings; relatively large flow rates may be required. The path of fluid flow, in all cases, is through the adapter. Thus a key characteristic of the adapter is fluid transfer capability.

Another key aspect of horizontal directional drilling is the detection of location and position of the drill head. This information is necessary to properly control the drilling process so that the bored hole is properly positioned. This is typically accomplished by installing tracking electronics in the drill head, typically in the form of a sonde. Sondes are currently available in a variety of sizes, from a variety of manufacturers and include 2 basic types; a type powered by a battery and a type powered by a wire that is threaded through the drill string to an above-ground power source.

An example of a battery powered sonde and its mounting configuration within a drill head is described in U.S. Pat. No. 5,633,589. FIG. 4 of '589 illustrates a drill head with the adapter assembly connected on one end to the drill string and to the drill bit at the other end. This is a schematic representation illustrating primarily the electronic package. This arrangement illustrates that the adapter assembly is configured to hold the sonde or transmitter which is generally cylindrical and whose diameter is significant in relation to the diameter of the drill rod. This static section of the adapter assembly has become known as the sonde housing.

Other examples of sonde housings can be seen in U.S. Pat. No. 5,799,740 (hereinafter '740), U.S. Pat. No. 5,253,721 (hereinafter '721), and U.S. Pat. No. 6,260,634 (hereinafter '634). FIG. 11 of '740 more closely exemplifies the design of typical sonde housings. The housing is configured to accept a sonde, to mate to a drill bit, to mate to the drill string, and to provide a passage for fluid. The mechanical configuration is such that a cavity for the sonde is positioned off center and located as close as possible to the edge of the adapter, as constrained by minimum material thickness. This provides a maximum cross-sectional area of the fluid passages, also constrained by minimum material thickness surrounding the passage. The location of the fluid passages is thus close to the outer diameter of the sonde housing.

In order to manufacture typical sonde housing passages, the sonde housing is made as two pieces. The cylindrical main section, illustrated as FIG. 11 in '740, includes a threaded section with an inner diameter sufficiently large to allow the fluid passages to be manufactured with normal drilling. This thread is much larger than the threads utilized on the drill rod. Thus a second piece, illustrated in FIG. 10, screws into these large threads on one end and adapts to the threads of the drill string on the other end. In this manner, the sonde housing is constructed from multiple parts that are screwed together. The sonde is installed into the sonde housing by separating the two pieces at this threaded connection. This type of sonde housing is referred to as an end load sonde housing as the sonde is inserted from an end of the sonde housing.

The cylindrical sonde housing illustrated in the '634 patent also utilizes a two piece construction. FIG. 2 illustrates a similar main section adapted to accept a sonde, adapted to a drill bit on one end, and to a second adapter on the opposite end. Rather than utilizing a threaded connection between the main section and the adapter, this sonde housing utilizes a splined connection. One such adapter is illustrated in FIG. 22 of U.S. Pat. No. 6,148,935 (hereinafter '935), and herein incorporated in its entirety by reference. Here again, the inner diameter of the splined connection is such that the fluid transfer holes can be drilled with normal drilling techniques. The sonde housing illustrated in the '634 patent is generally referred to as a side load housing as the sonde housing includes a door that covers the sonde cavity mounted on the side of the sonde housing and the sonde is accessed from the side.

FIG. 1 of '935 and FIG. 3 of '721 illustrate the difficulty of manufacturing a one-piece sonde housing. In '935 the fluid transfer holes are drilled at an angle, adding cost and complexity to the assembly. In '721 the fluid transfer holes require 4 separate, intersecting drilled holes creating 90-degree angles in the fluid pathway. This configuration results in significant flow restriction.

In addition to providing a flow passage, the sonde housing also serves to support and position the sonde. U.S. Pat. Nos. 6,260,634 and 6,148,935 illustrate the use of a splined connection between the sonde housing and the drill bit that can only be Assembled in one rotary orientation. This, combined with the rotary orientation control of the sonde, coordinates the orientation between the sonde and the drill bit. This arrangement is dependent on the splined connection, which results in restricting the variety of drill bits that can be utilized with the housing, as not all bits include such splines.

Other mounting requirements for sondes include vibration isolation, particularly when the adapter assembly includes a hammer, and/or provision for a wire passage for use with a wire-line sonde. The sonde housing, being located near the drill bit, is subjected to severe load conditions. The mechanical rigidity and assembly characteristics affect the durability of the sonde housing. The requirement for durability is exemplified by the existence of industry standards for certain types of drilling components. For instance, the American Petroleum Institute has adopted a specific thread configuration for use with drilling components that imposes an additional physical constraint affecting the mechanical configuration of the sonde housing.

SUMMARY

One aspect of the present invention relates to an enhanced sonde housing for use in the horizontal directional drilling industry. Another aspect of the present invention relates to the method of manufacturing the enhanced sonde housing.

DETAILED DESCRIPTION

Figure 1:
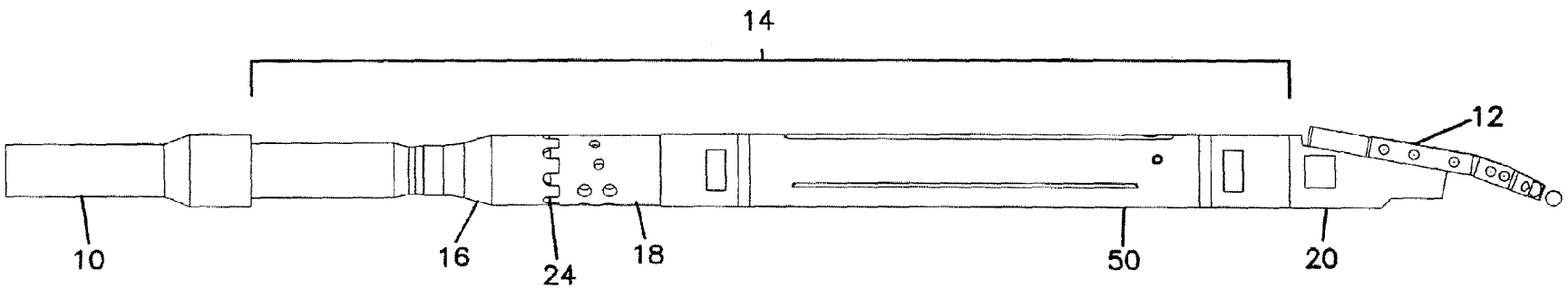
FIG. 1 is a side view of one embodiment of a drill head assembly according to the present invention mounted onto a drill string in a first set-up with a bit adapted for boring in soft rock.

With reference now to the various figures in which identical elements are numbered identically throughout, a description of various exemplary aspects of the present invention will now be provided. The preferred embodiments are shown in the drawings and described with the understanding that the present disclosure is to be considered an exemplification of the invention and is not intended to limit the invention to the embodiments disclosed.

Referring now to the drawings, FIG. 1 illustrates one embodiment of a drill head set-up having a sonde housing assembly 50 according to the present invention. Drill string 10 terminates at a first end of a drill head assembly 14 and connects at an opposite end to a drilling machine (not shown) capable of providing rotation and longitudinal power. The drill string 10 is typically constructed of hollow tubing and is capable of transferring pressurized fluid. In the configuration shown in FIG. 1, a drill bit 12 connects to an opposite end of the drill head assembly 14.

The drill head assembly 14 consists of a rear transition sub 16, a rear adapter sub 18, a front adapter sub 20 and the sonde housing assembly 50. In this configuration the rear adapter sub 18 is configured to mate with the rear transition sub 16 in order to utilize a joint 24. An exemplary joint used in this type of configuration is described in U.S. Pat. No. 6,148,935, which is herein incorporated by reference in its entirety. Joint 24 allows for convenient separation between the drill string 10 and the rest of the drill head, in particular, the rear transition sub 16 remains attached to the drill string 10 while the remaining portion of the drill head assembly 14 and the drill bit 12 are removed. In use, this configuration requires less tools to remove the portion of the drill head assembly and drill bit after drilling a pilot hole and attach a reamer having a similar transition sub. In the embodiment of FIG. 1, the backreaming would be completed without the sonde housing assembly 50.

Figure 2:
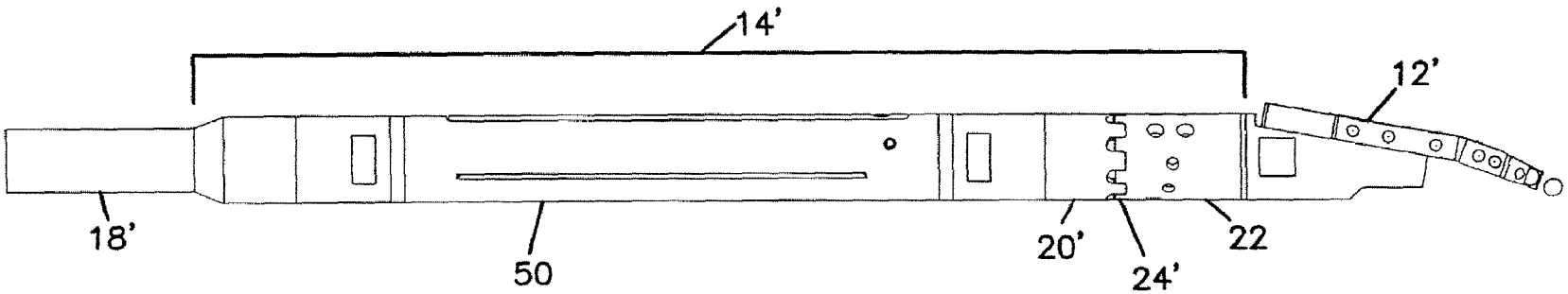
FIG. 2 is a side view of another embodiment of a drill head assembly according to the present invention mounted onto a drill string in a second set-up with a bit adapted for boring in soils.

FIG. 2 illustrates an alternative embodiment of a drill head set-up having a sonde housing assembly 50 according to the present invention. In this illustration, the drill head assembly 14' does not include a rear transition sub, as in 16 of FIG. 1, but does include a front transition sub 22 configured with a joint 24' and a front adapter sub 20'. This configuration allows a drill bit 12' and front transition sub 22 to be removed with minimal tools. A reamer (not shown) configured with a splined transition sub that mates with joint 24', similar to that found on transition sub 22, can then be connected. In the embodiment of FIG. 2, the sonde housing assembly 50 is left installed during backreaming.

Figure 3:
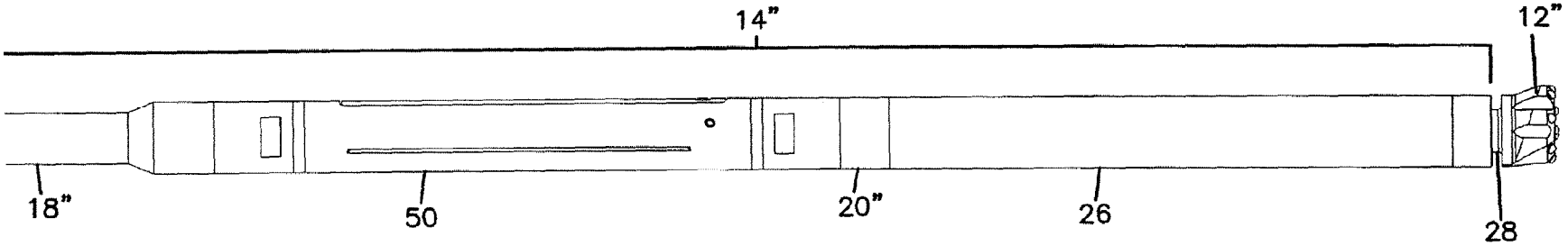
FIG. 3 is a side view of yet another embodiment of a drill head assembly according to the present invention mounted onto a drill string in a third set-up with a hammer and bit adapted for boring in hard rock.

FIG. 3 illustrates yet another embodiment of a drill head set-up having a sonde housing assembly 50 according to the present invention. An exemplary joint used in this type of configuration is described in U.S. Pat. No. 6,148,935, which is herein incorporated by reference in its entirety. Drill head assembly 14" includes a rear adapter sub 18", a sonde housing assembly 50, a front adapter sub 20", and a hammer 26. The hammer includes a front shaft 28 capable of supporting a bit 12".

From these three exemplary embodiments it is obvious that there is a multitude of possible set-ups, each potentially affecting the configuration of the sonde housing assembly 50. These three are only typical examples, and many other configurations and embodiments are possible. As a result of the many various applications and requirements, there are currently a number of specific configurations of sonde housings available. It is an desirable to provide a universal sonde housing that is capable of being used in a wide variety of drill head configurations that also provides minimum flow restriction, maximum mechanical rigidity, flexibility in mounting arrangements for differing sondes, and flexibility in accepting adapters between the housing and drill bits or drill string. In addition, the use of sondes during backreaming is possible and a sonde housing capable of handling relatively large flow rates with flexibility in accepting adapters will be an improvement.

Figure 4:
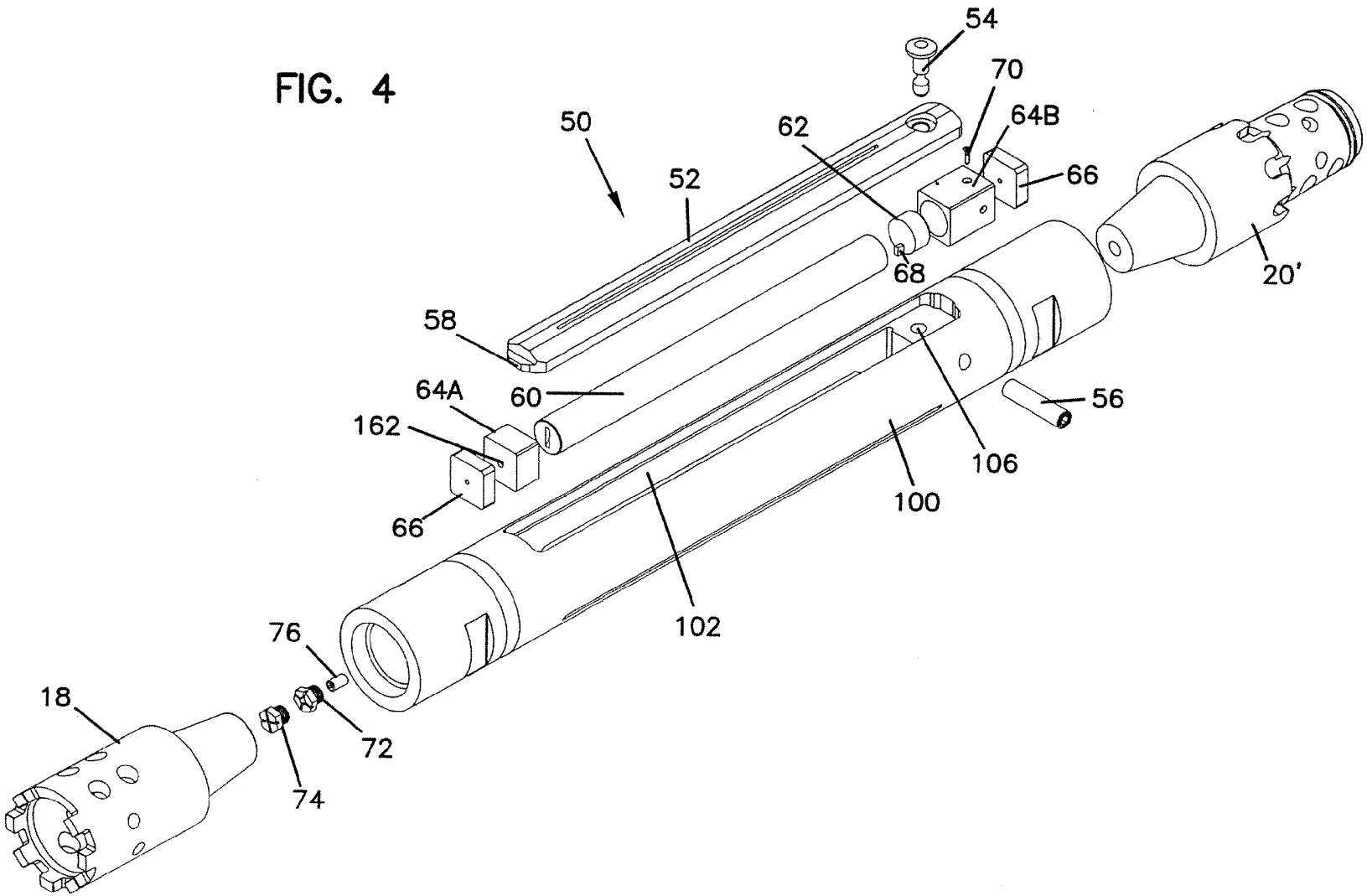
FIG. 4 is an exploded view of a sonde housing assembly according to the present invention.
Figure 5:
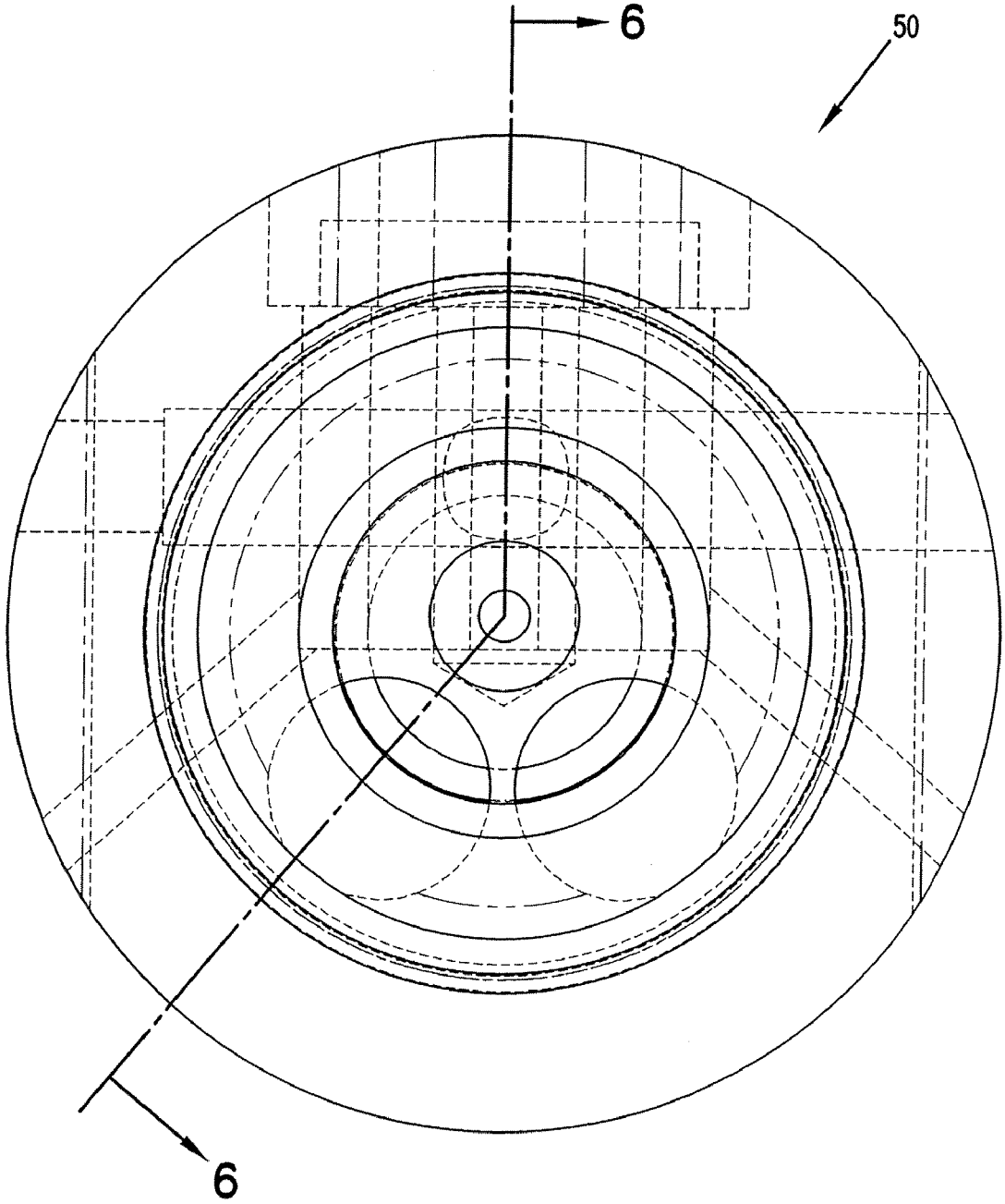
FIG. 5 is an end view of a sonde housing according to the present invention.
Figure 6:
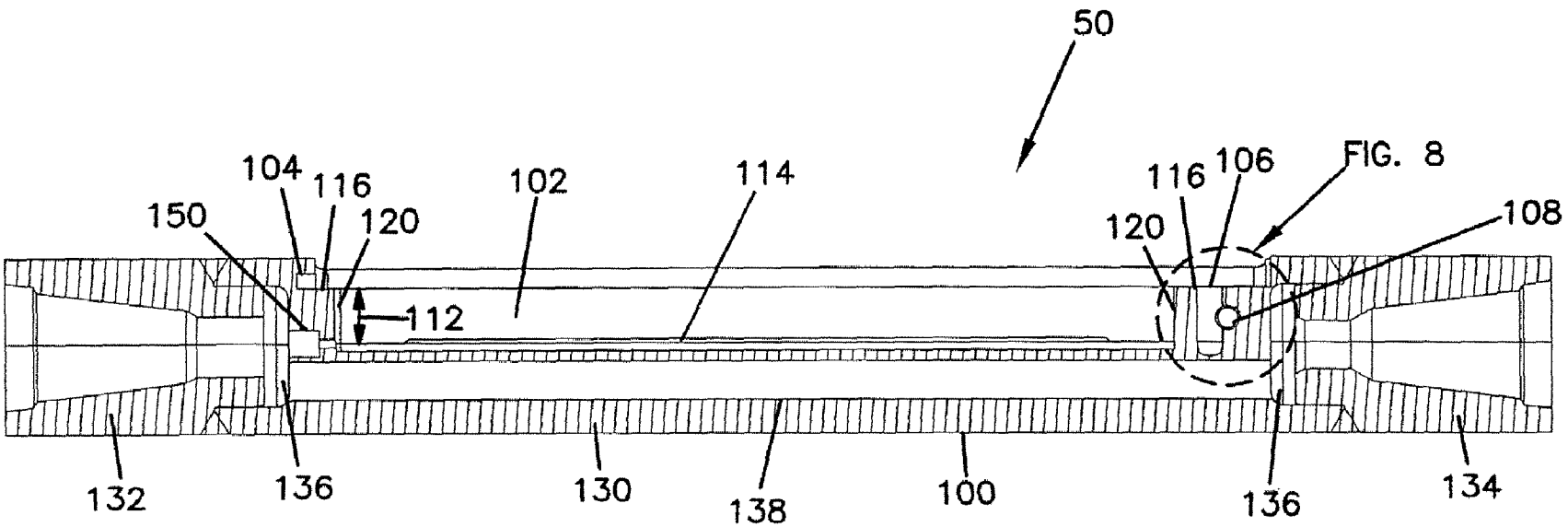
FIG. 6 is a cross section of the sonde housing of FIG. 5 taken along line 6—6.
Figure 8:
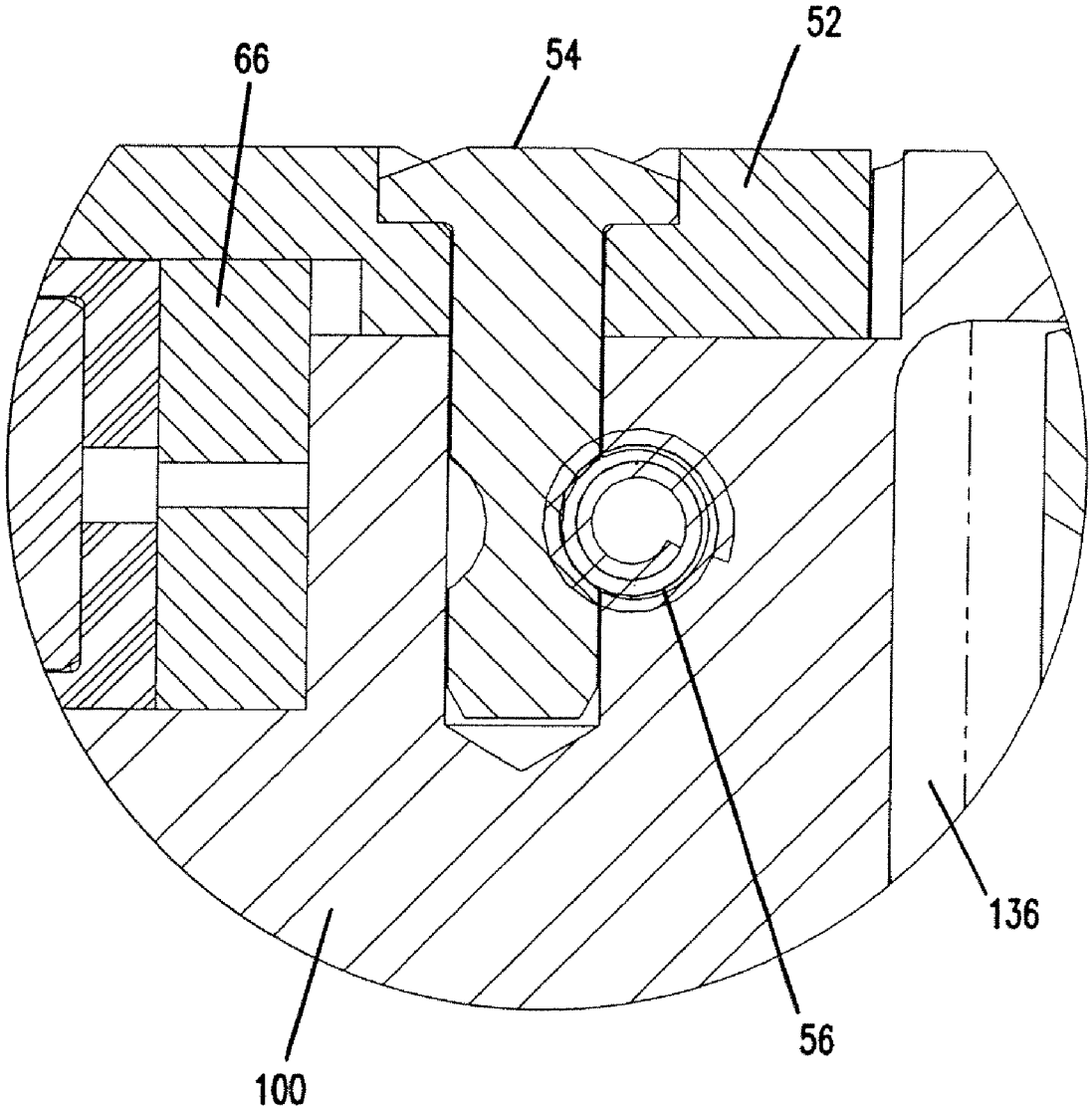
FIG. 8 is an enlarged cross section of the sonde door retaining pin section shown in FIG. 6.

FIG. 4 illustrates the components found in the sonde housing assembly 50 according to the principles disclosed. The main component is main housing 100. A cavity 102 is accessible by removing a sonde door 52. The sonde door 52 is retained on one end by a tab 58, which engages into a slot 104 (see FIG. 6) of the main housing 100. The other end is retained by a door latch pin 54 which is installed into hole 106. A surface 120, best shown in FIG. 6, supports the sonde door 52. The door latch pin 54 is then retained in the main housing 100 by a retainer pin 56 which is driven into a through hole 108 that intersects hole 106 as illustrated in FIGS. 6 and 8. In order to remove the sonde door, the retainer pin 56 is easily removed with standard tools, including a hammer and punch. The door latch pin 54 is then free to be removed by lifting the sonde door 52 in an angular motion, pivoting around its tab 58, until the sonde door and latch pin clear the sonde cavity.

Figure 7A:
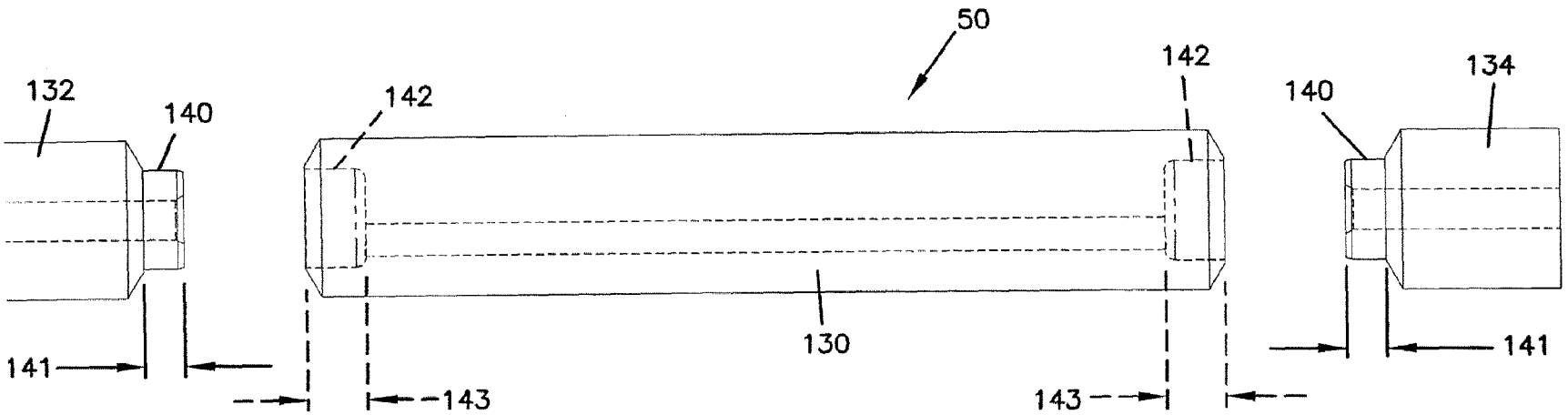
FIG. 7A is an exploded side view of a sonde housing according to the present invention prior to assembly for welding.
Figure 7B:
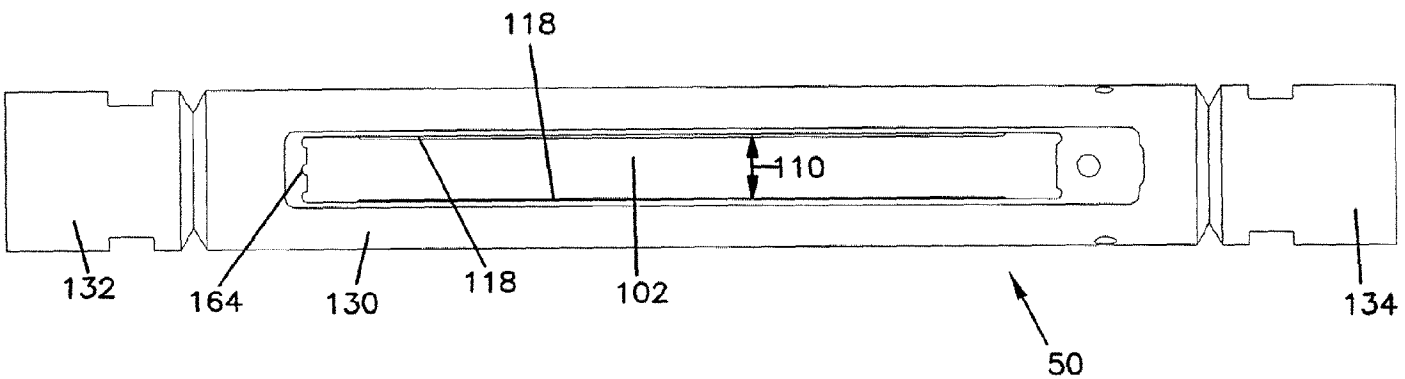
FIG. 7B is an assembled top view of the sonde housing of FIG. 7A.
Figure 9:
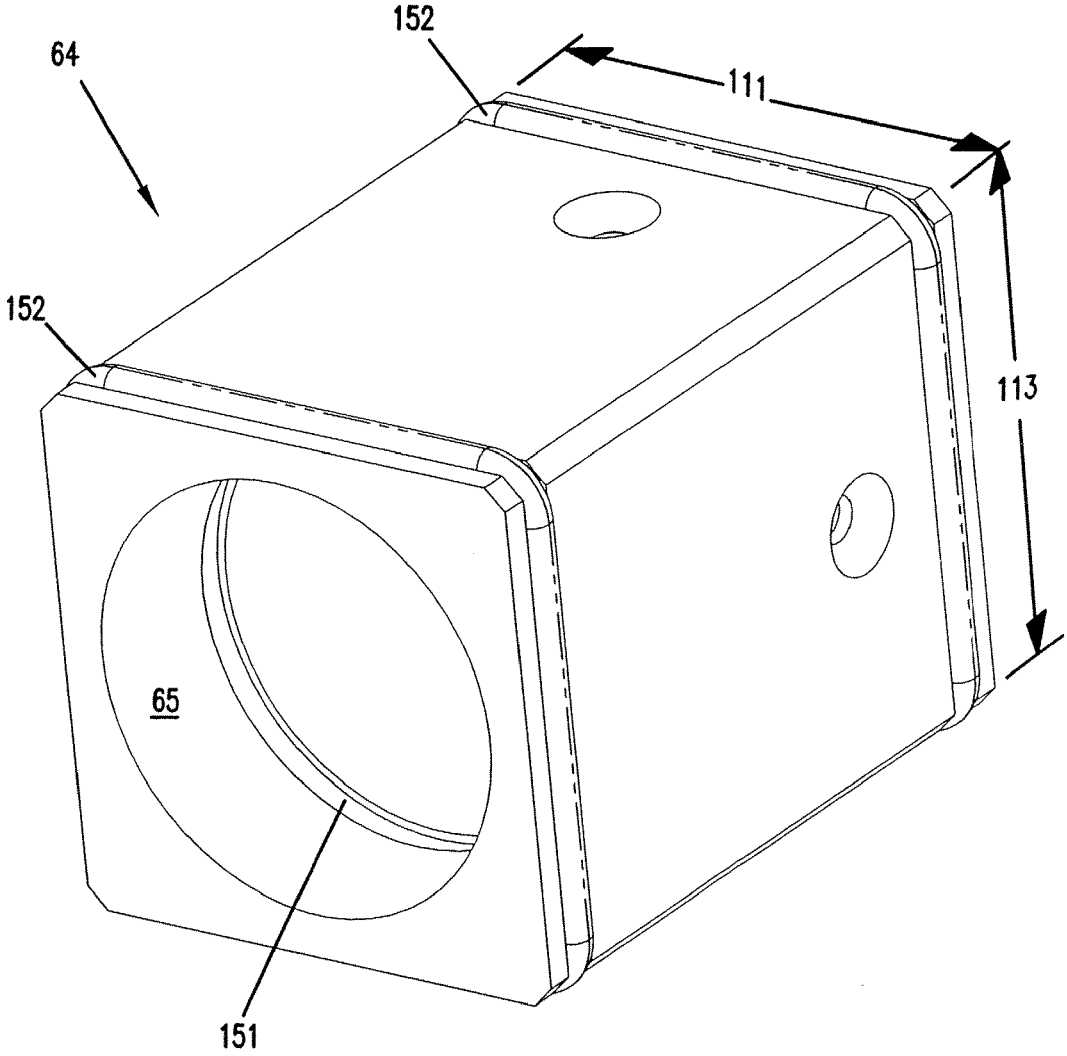
FIG. 9 is an isometric view of the sonde mounting block according to the present invention.

The sonde 60 fits into cavity 102. The cavity 102 is defined by a depth 112 as illustrated in FIG. 6 and a width 110 as illustrated in FIG. 7B. The sonde 60 is supported by mount blocks 64A & 64B, one on each end. As illustrated in FIG. 9, the mount blocks 64A and 64B include a cavity 65 with an inner diameter selected relative to the outer diameter of sonde 60 to position and support sonde 60. The cavity 65 may include a groove manufactured to capture an O-ring 151 to support and center the sonde 60.

Figure 10:
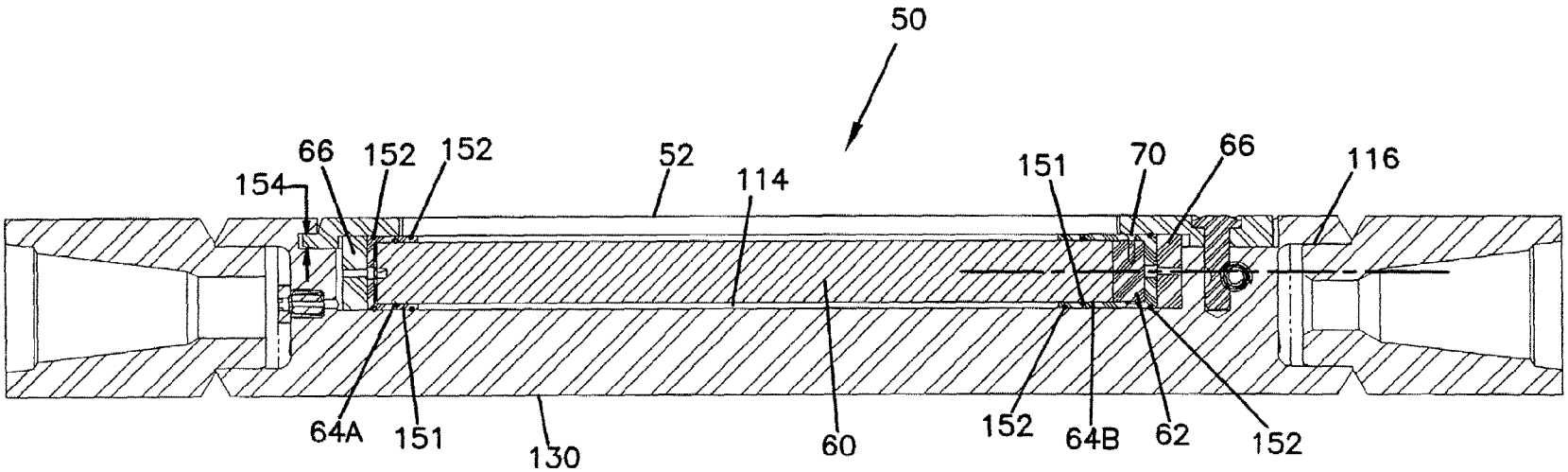
FIG. 10 is a cross-sectional view of the sonde mounting assembly according to the present invention.

The mount blocks 64A and 64B are supported within the cavity 102. The cavity 102 is defined by the main housing 100 and the sonde door 52. The blocks 64A and 64B are constructed so that their width 111 is slightly less than the cavity width 110. In this illustrated embodiment the sonde door 52 includes a slot of depth 154, as illustrated in FIG. 10, that cooperates with cavity 102 to retrain the blocks 64A and 64B. The height 113 of blocks 64A and 64B is slightly less than the sum of cavity depth 112 and the slot depth 154 respectively. In this manner, the blocks are mounted so that they are free to move, specifically, slide longitudinally relative to the sonde housing 100 and sonde door 52, yet are securely supported when the sonde door 52 is installed.

The mount blocks 64A and 64B are constructed from any material that will aid in properly supporting the sonde 60. The preferred material is a type of plastic so that the cavity 65 can be sized to fit the sonde 60 relatively tight without causing any damage to the sonde 60. Several configurations of mount blocks 64A and 64B can be made available, each having a cavity 65 specific for a certain type of sonde, yet with the same outer dimensions (i.e. width 111 and height 113). In this manner the main housing 100 remains unchanged, while the assembly is capable of accepting sondes 60 of various diameter and or configuration.

The bottom surface 114 of the cavity 102 and the bottom surface of the sonde door 52 support the mount blocks 64A and 64B along the radial axis. They are supported along the axis perpendicular to the radial axis and the longitudinal axis by the side surfaces 118 of the cavity 102. Along the longitudinal axis the mount blocks 64A and 64B are supported by axial vibration isolators 66 which are supported by end surfaces 120, which are effective due to the built-in clearances in the block mounting. The assembly is illustrated in FIG. 10.

The axial vibration isolators 66 can be constructed of a variety of materials, selected for the dynamic compression characteristics, to act to reduce the vibration loading transferred to the sonde 60. This is useful in applications involving a percussive hammer where the percussive hammer produces primarily longitudinal vibrations. Isolation in the other two axis may be provided by constructing the mount blocks 64A and 64B of material with appropriate compression characteristics or implementing non-axial vibration isolators between the support blocks 64A and 64B and surfaces 118 and 114.

One possible embodiment of such isolators is illustrated in FIGS. 9 and 10. External o-rings 152 are designed to fit into grooves machined on the outer surface of blocks 64A and 64B. Proper clearances between the block dimensions 111 and 113 and the cavity dimensions 110 and (112+154) need to be determined for the vibration isolation to be effective.

In addition to being supported along the longitudinal axis, the longitudinal axis of the sonde 60 is ideally aligned with the longitudinal axis of the sonde housing assembly 50. This is useful in certain applications that require precise control of the grade of the bore, such as installation of gravity sewers. Commonly, traditional sondes include pitch sensors capable of measuring the pitch of the longitudinal axis, for example, when the sonde housing is level, the measured pitch is zero. However, there are inherent manufacturing tolerances and stack-up problems of the mounting component that can introduce some angularity error. Thus, it is desirable to improve the process of drilling with sondes by providing a mechanical adjustment that can be used to compensate for the error inherent with the sonde. Also, sonde housings are generally constructed to approximately align the longitudinal axis of the sonde with the longitudinal axis of the sonde housing. However, the precision of the orientation of the sonde's mounting in the sonde housing may also introduce unwanted alignment error. In order to correct such errors, an adjustment assembly 171 as shown in FIG. 12 can be utilized to correct the alignment.

Figure 12:
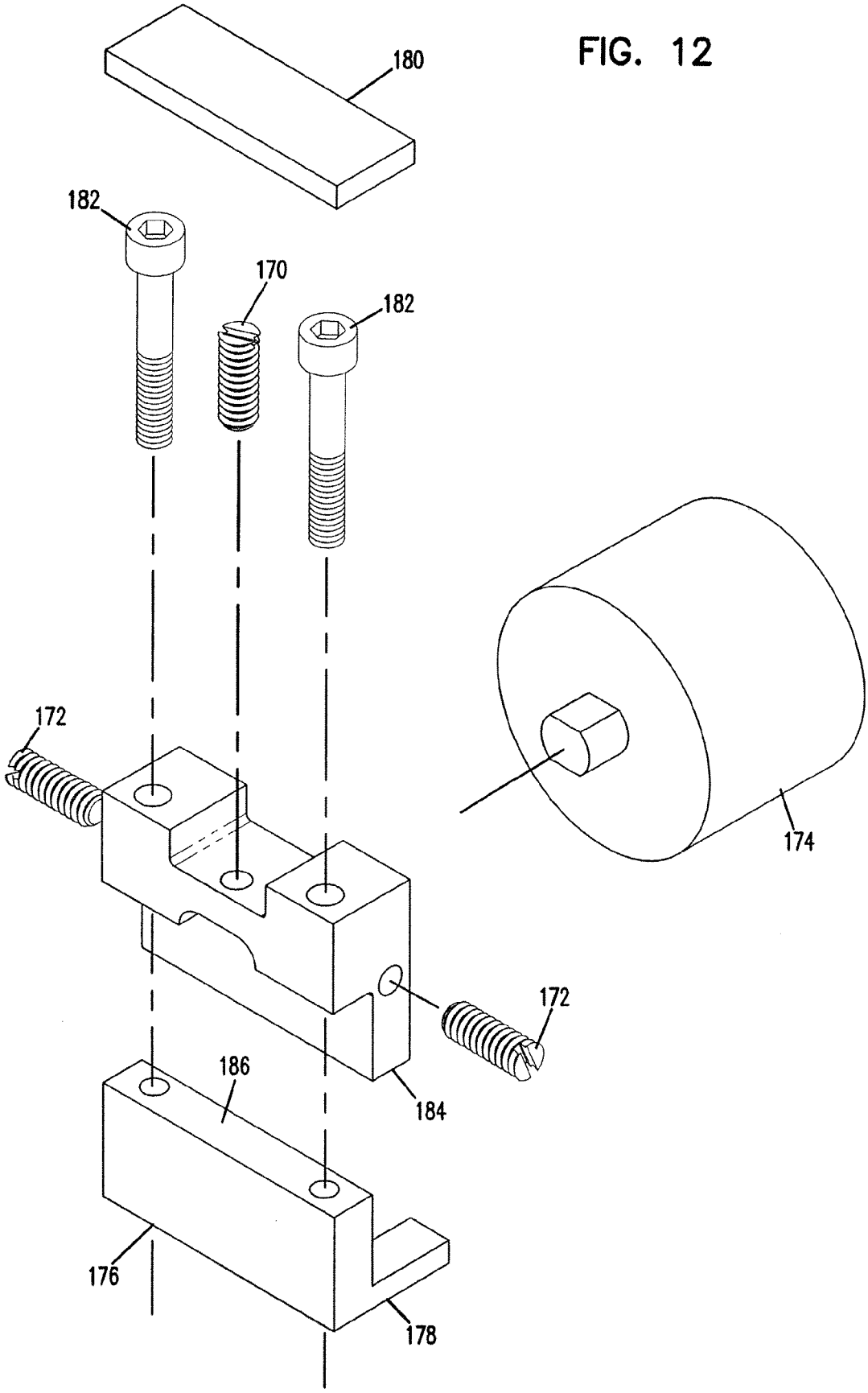
FIG. 12 is an exploded view of an alternate sonde mounting assembly according to the present invention.

In utilizing an adjustment assembly 171, the block 64B is replaced with the assembly 171 shown in FIG. 12. The adjustment assembly includes an adjustment screw 170 capable of moving the centerline of a supporting cap 174, in a first direction, relative to an outer surface 178 of a lower base 176. The adjustment screw 170 threads into upper base 184 and seats against upper surface 186 of the lower base 176 such that if the screw 170 is screwed into the upper base 184, the upper base 184 will move away from the lower base 176. The supporting cap 174 engages with the upper base 184 and is thus moved. Screws 182 are utilized to lock the upper base 184 to the lower base 176 once the proper setting is achieved. The lower base 176 will seat in the cavity 102 and be supported by surface 114.

In assembling the components, the sonde will be positioned in the supporting block 64 on one end, and in the adjustment assembly 171 on the other end (e.g. a similarly sized cavity within the supporting cap 174 (not shown) as that of the supporting block cavity 65). That assembly is then inserted into the cavity 102, supporting the sonde. The sonde housing assembly is positioned to be at a known pitch, typically level. The reading from the sonde is checked. The screws 182 and 170 can then be manipulated until the sonde pitch reading is correct. Once correct, an isolator block 180 is installed on top of screws 182 and the upper base 184. When the sonde door 52 is installed, this assembly is slightly compressed to assure the lower base 176 remains properly positioned against surface 114 of the sonde housing 100.

Screws 172 are also provided to position the supporting cap 174 in relation to the upper base 184 in order to provide adjustment in the other plane.

Figure 13:
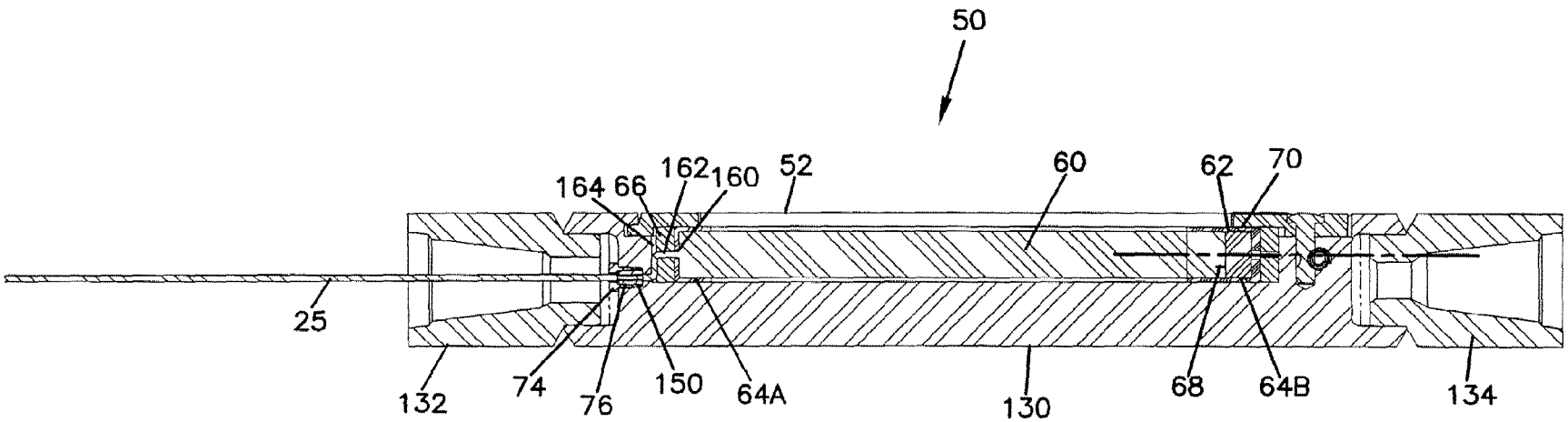
FIG. 13 is a cross-sectional view of the wireline routing for a wireline sub according to the present invention.

Referring now to FIGS. 10 and 13, a cylindrical plug 62, orientation tab 68 and screw 70 define the rotary orientation of the sonde within the assembly. The mount blocks 64A and 64B are rectangular in cross section, fitting into cavity 102 that is likewise rectangular in cross section. Thus mount blocks 64A and 64B are fixed relative to the main housing 100. The plug 62 is cylindrical and fits into the cylindrical cavity 65 within mount block 64A. The sonde 60, typically cylindrical, also fits into the cylindrical cavity 65 of mount block 64A.

Figure 11:
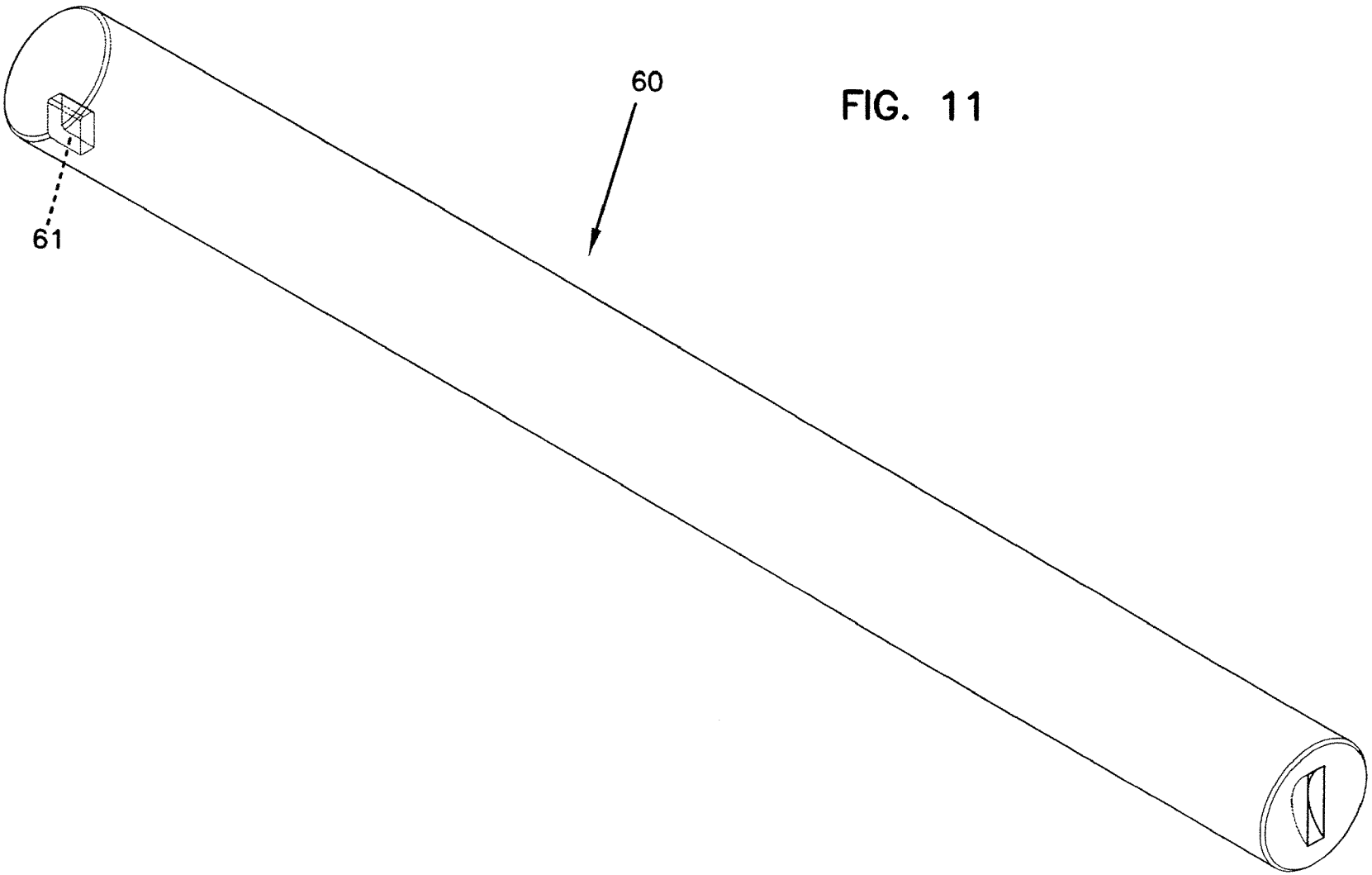
FIG. 11 is an isometric view of a typical sonde.

In one embodiment, the sonde 60 includes a slot 61 that assists in defining its rotary orientation, as shown in FIG. 11. Upon installing the plug 62, mount blocks 64A & 64B, orientation tab 68, sonde 60 and isolators 66 into the cavity 102, the sonde 60 may be rotated within cavity 65 of mount blocks 64A and 64B. As the sonde 60 is rotated, the plug 62 also rotates relative to mount blocks 64A and 64B. Once the sonde 60 is positioned in the proper rotary orientation, a screw 70 is installed through the mount block 64A and into the plug 62 locking the plug into position and thereby defining the rotary orientation of the sonde 60 relative to the mount blocks 64A and 64B, and ultimately relative to the main housing 100. This embodiment requires a simple through hole be provided in the mount block 64A for the screw to pass through. In an alternate embodiment, not shown, mount block 64A could include a threaded hole. A set screw could engage these threads and then simply contact the plug, without extending into the plug, to lock the plug into position.

Figure 14:
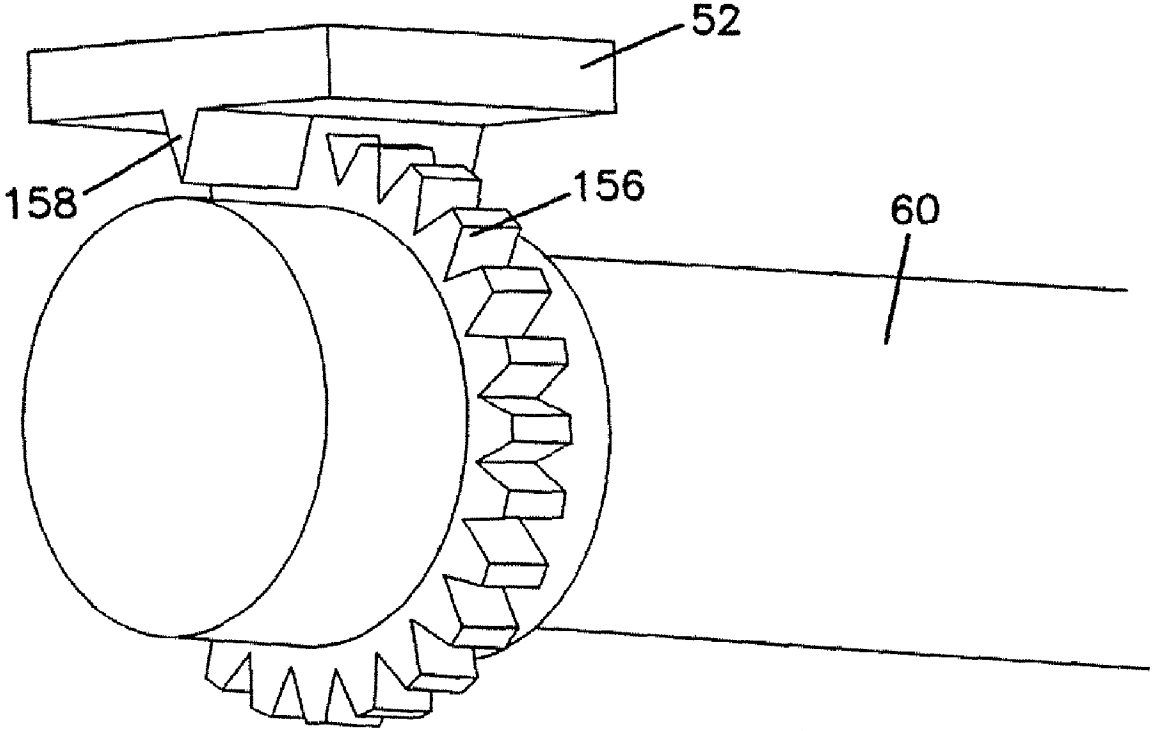
FIG. 14 is an isometric view of a second embodiment of a sonde rotary orientation control including a tab on the door that engages a gear on the sonde.
Figure 15A:
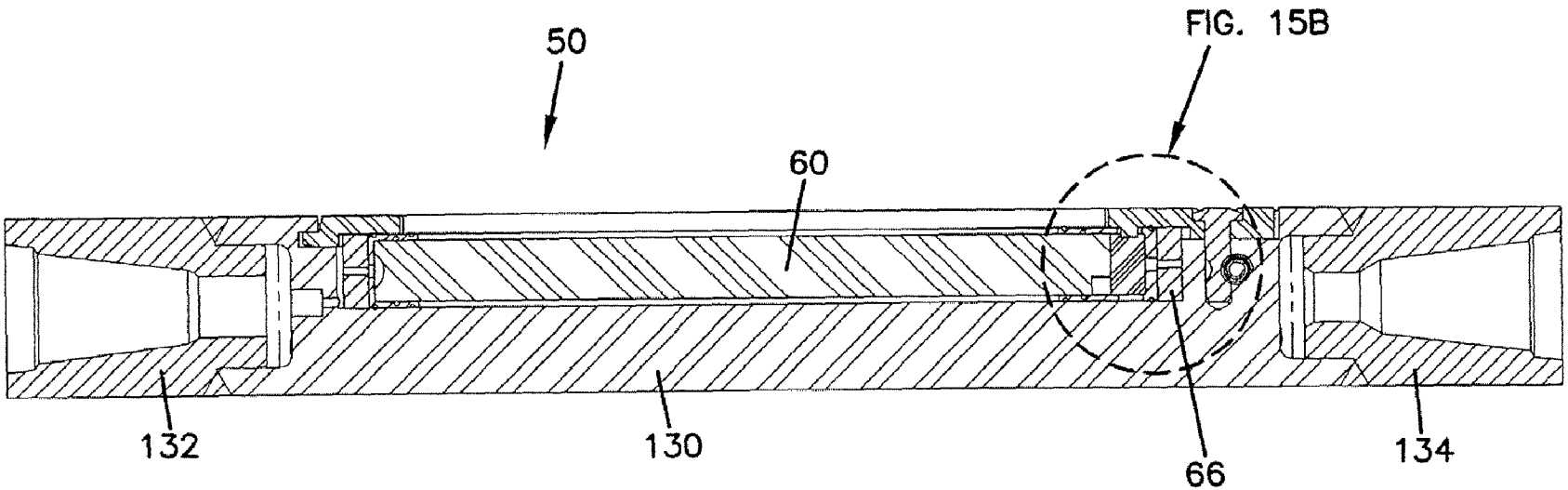
FIG. 15A is a longitudinal cross sectional view of a third embodiment of a sonde rotary orientation control including a tab on the door that engages a plug.
Figure 15B:
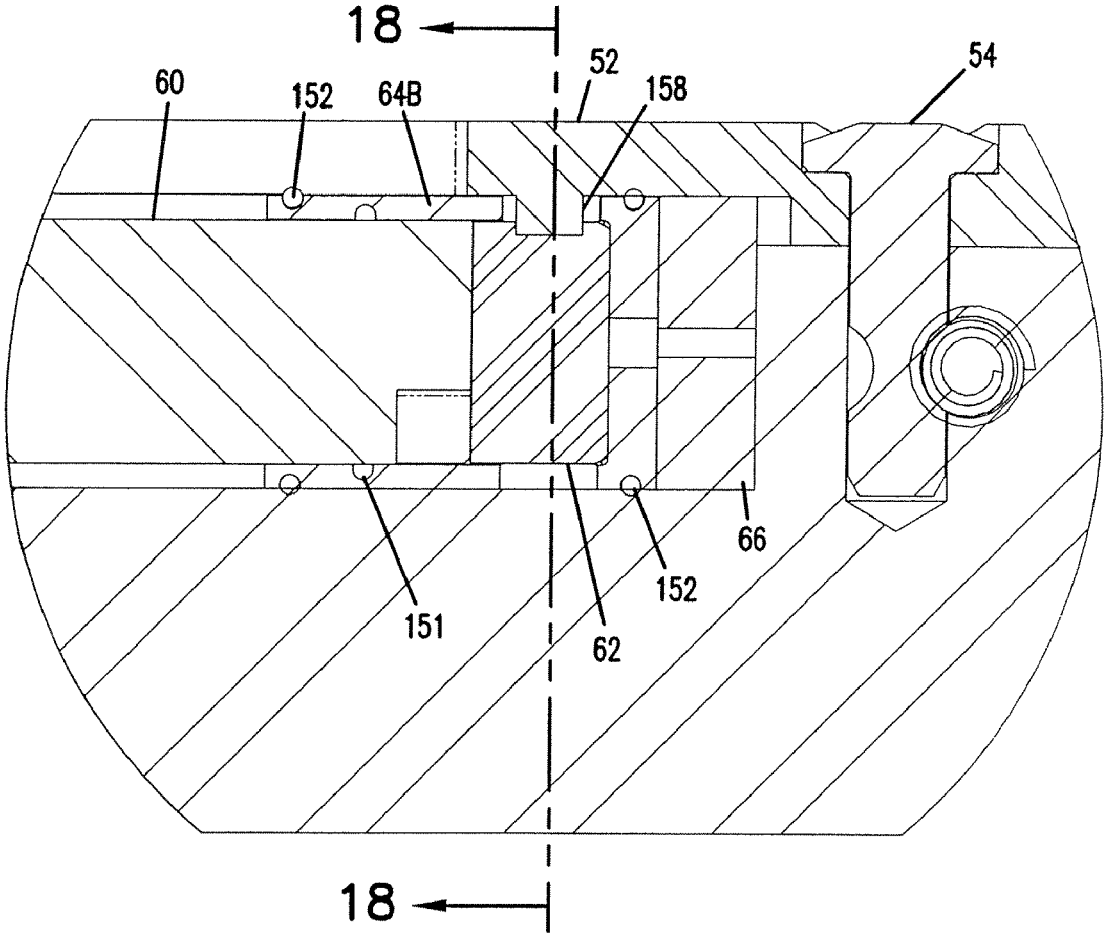
FIG. 15B is an enlarged view of the rotary orientation control section of FIG. 15A.
Figure 16A:
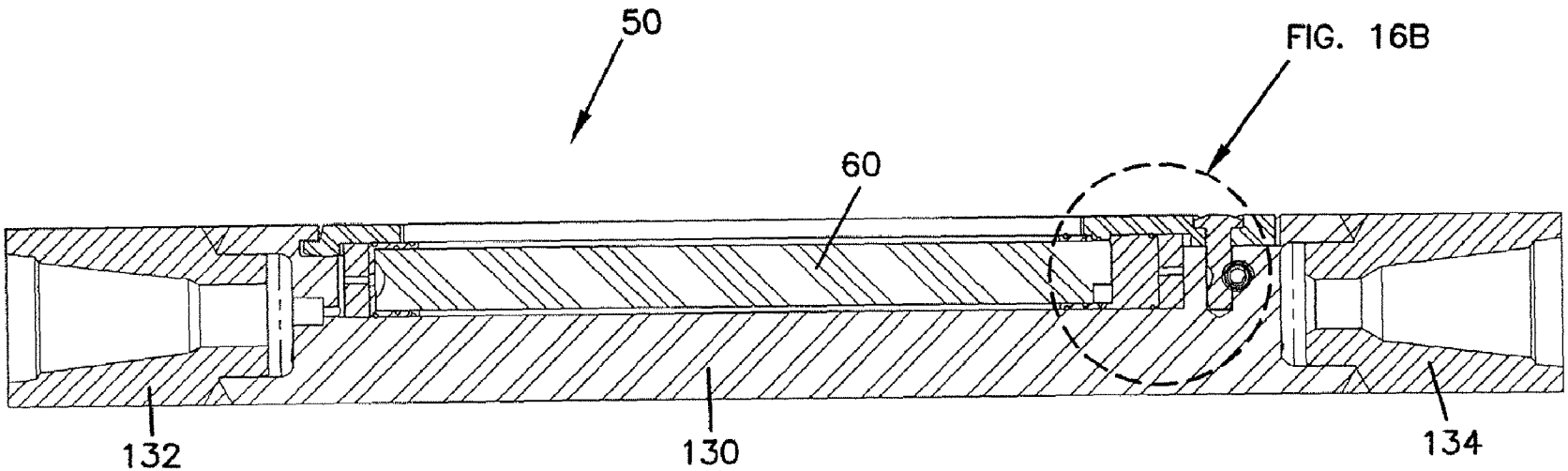
FIG. 16A is a longitudinal cross sectional view of a fourth embodiment of a sonde rotary orientation control including a tab on the door that engages an o-ring in contact with the sonde.
Figure 16B:
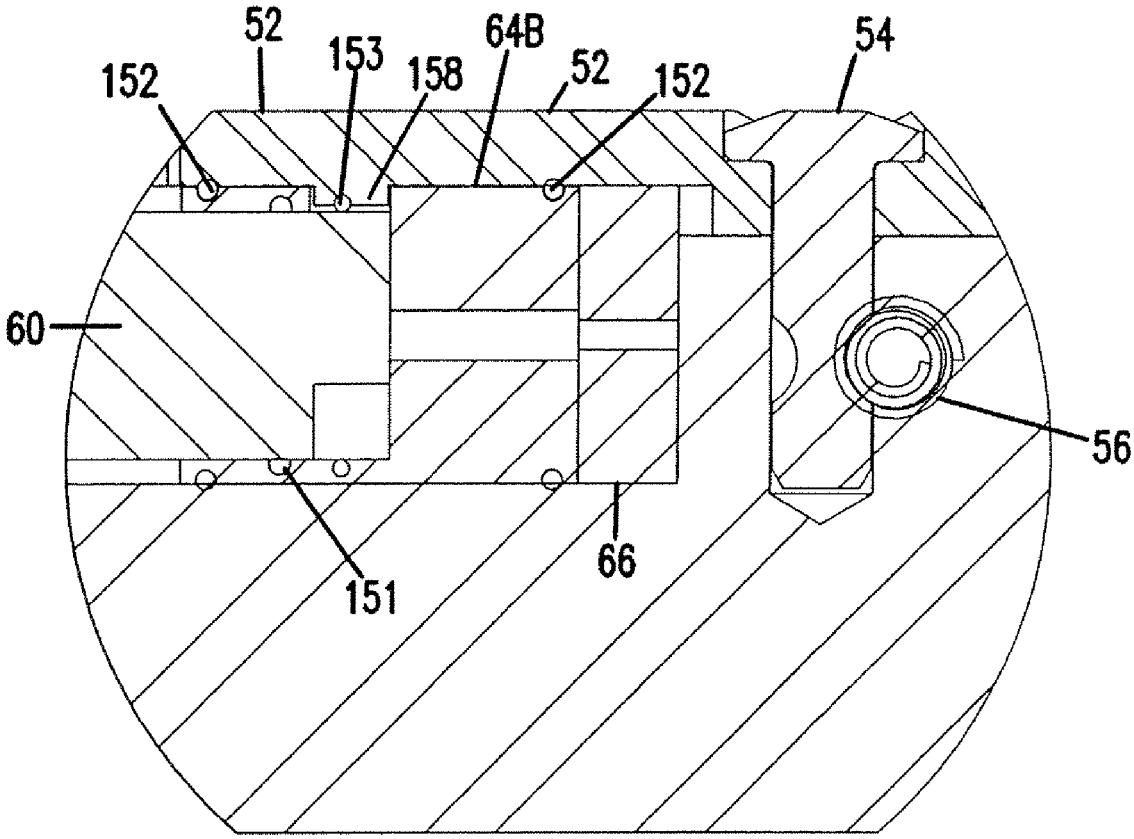
FIG. 16B is an enlarged view of the rotary orientation control section of FIG. 16A.
Figure 17A:
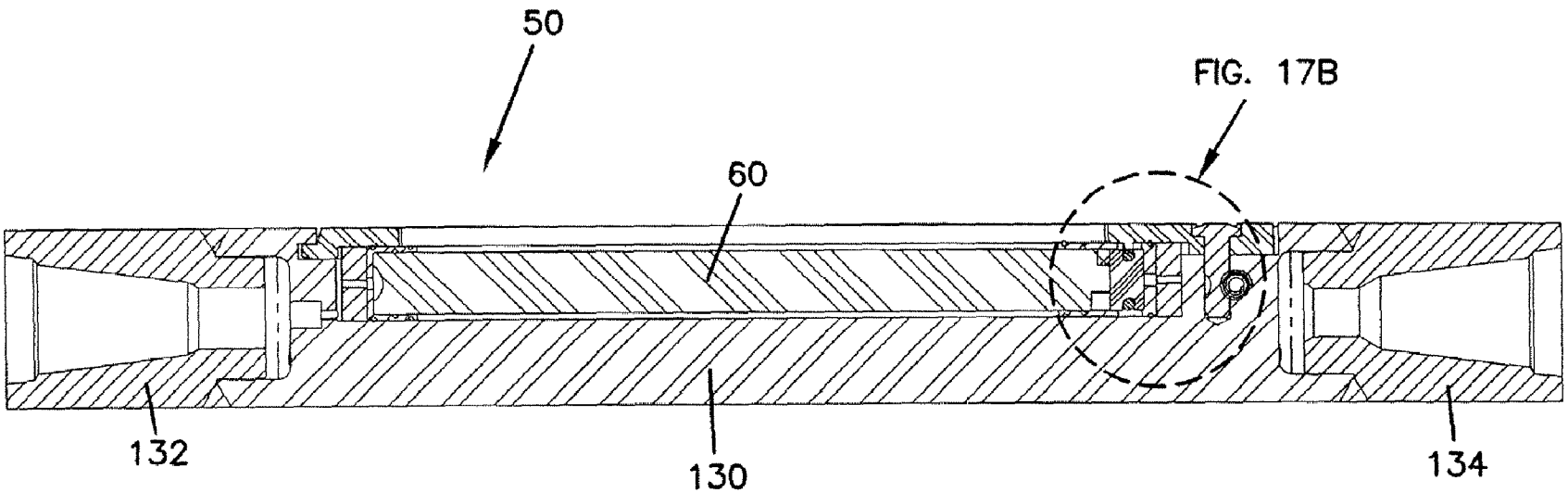
FIG. 17A is a longitudinal cross sectional view of a fifth embodiment of a sonde rotary orientation control including a tab on the door that engages an o-ring in contact with a plug that engages the sonde.
Figure 17B:
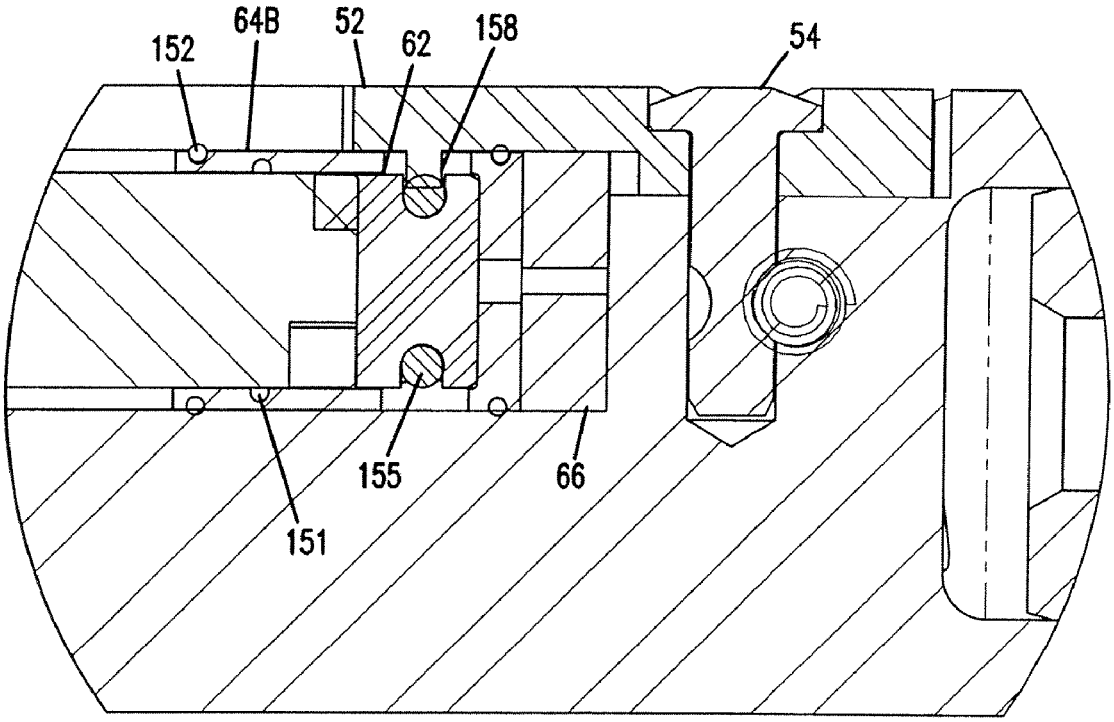
FIG. 17B is an enlarged view of the rotary orientation control section of FIG. 17B.
Figure 18:
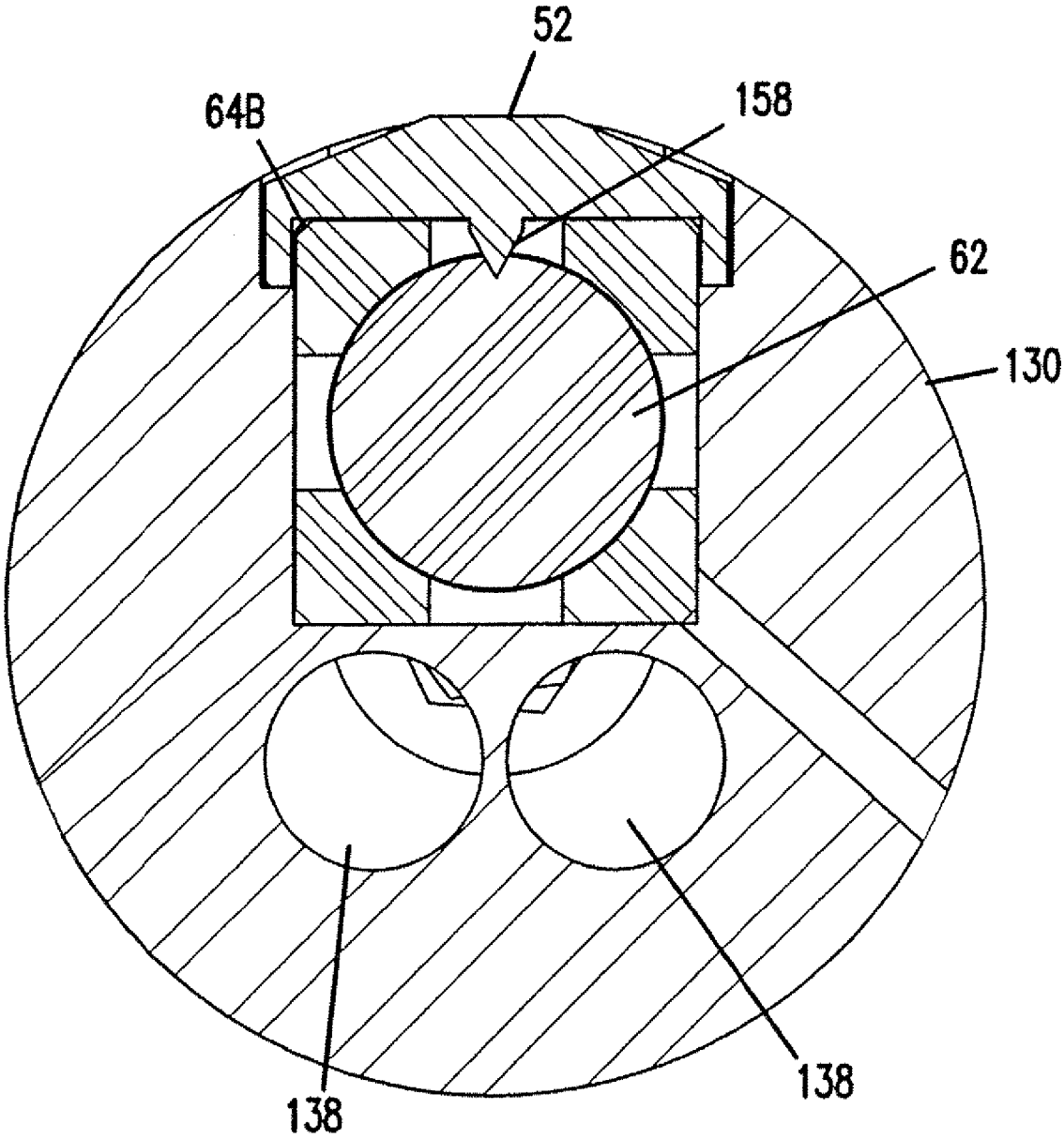
FIG. 18 is a radial cross sectional view representative of the sonde door and plug within the housing of FIG. 15B taken along the line 18—18.
Figure 19A:
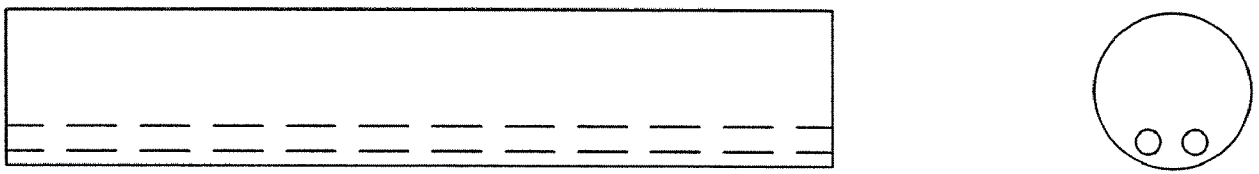
FIGS. 19A–19E are schematic illustrations of the stages of manufacturing for an alternate method of manufacturing a sonde housing of the present invention.
Figure 19B:
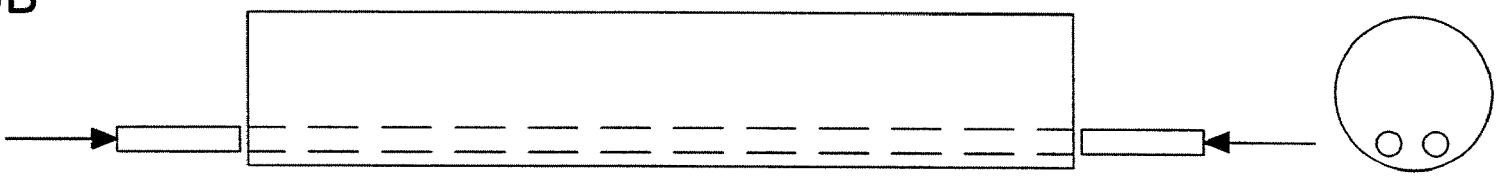
Figure 19C:
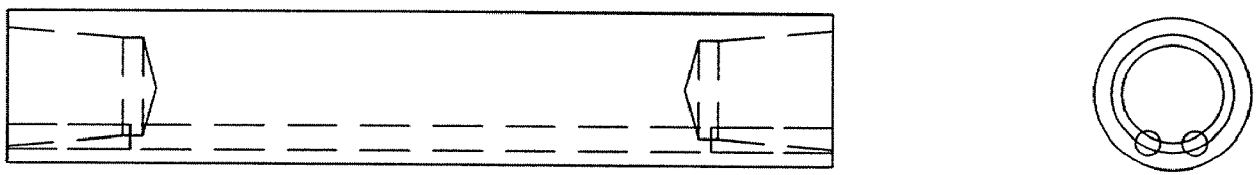
Figure 19D:
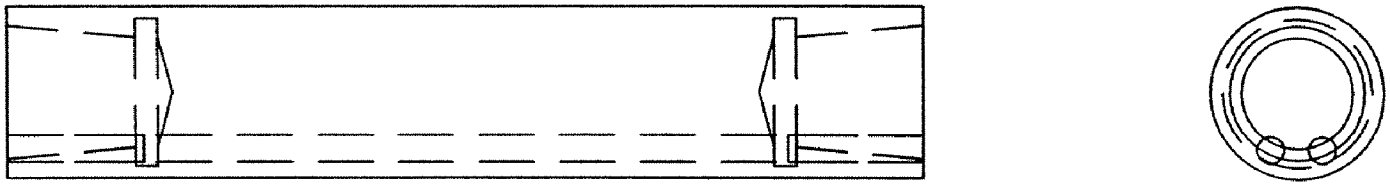
Figure 19E:
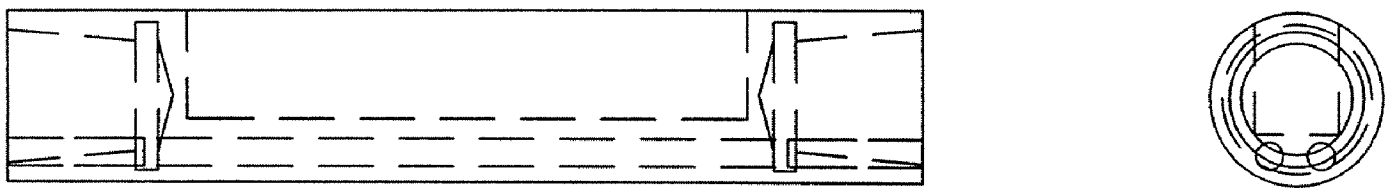

Yet another alternative embodiment that rotationally orients a sonde is illustrated in FIG. 14. In this embodiment the sonde door 52 includes a rib 158 that projects downward to engage with a gear 156. The gear 156 is secured to the sonde 60. In this configuration, the rotary orientation of the sonde 60 is set or locked upon installation of the sonde door. Additional embodiments are illustrated in FIGS. 15A–B, 16A–B and 17A–B wherein the rib engages: the plug 62, as shown in FIGS. 15A–B; an o-ring 153 that is in contact with the sonde 60, as shown in FIGS. 16A–B; or an o-ring 155 that is installed onto the plug 62, as shown in FIGS. 17A–B. In all of these embodiments, the rib restrains the rotation of the sonde whenever the door 52 is installed.

The rotary orientation of the sonde ultimately needs to be defined relative to a directional control element of a drill head. In the horizontal directional drilling process, the ability to control the direction of the boring is a result of some physical property of the drill bit, or of some other physical property of the drill head. There are a variety of designs available that provide directional control, each having its own benefits associated with various soils or setups. The operators typically know how the setups will steer in the ground and are thus capable of positioning the assembled drill head in a rotary position to steer in a certain direction. For instance an operator is expected to be able to assemble a drill head and roll the drill head into a rotary position so that the drill head steers upward. This is typically known as steering at 12:00. Likewise the operator is expected to be able to position the drill head in the rotary position to steer right, 3:00, downward, 6:00, or left 9:00.

The method of setting the rotary orientation of a sonde within a drill head according to the principles of this disclosure are as follows:

1) operator assembles the drill head completely, including drilling bit, except for installation of the sonde door 52;
2) operator positions the drill head into any desired rotary position (ie: 12 o'clock);
3) operator checks the output from sonde 60 via sonde signal receiver/decoder and then modifies the rotary orientation of the sonde 60 by rotating it within the cavity 102 until it is reading the correct orientation, as determined by how the drill head was previously positioned; and
4) operator then installs screw 70 through the mount block 64 a and into the cylindrical plug 62 to lock the assembly into position or simply installs the sonde door with one of the embodiments illustrated in FIGS. 14, 15, 16 and 17.

One advantage of this method is that this method allows for an infinitely accurate rotational orientation of the sonde to the sonde housing, and allows the operator to modify the position of the sonde in the cavity. Another advantage of this method is that this method allows the sonde housing to be adaptable to any drill head assembly. In many instances the directional control element of the drill head relative to the sonde housing assembly will be defined by the rotary orientation of the front adapter sub 20 as located on the sonde housing assembly 50; this connection is seldom modified. In such cases, the mounting block 64A, plug 62 and screw 70 can be left assembled when changing drill bits or sondes. Thus, the process of orienting the sonde is not necessary each time the drill head is worked on. It is expected that once assembled, the drill heads are typically dedicated to a certain type of set-up, and adjustments are not performed frequently. It is therefore beneficial that one sonde can easily be adapted to any known drill head set-up.

Aside from the variations in drill head physical characteristics, and physical variations of sondes, there are two basic types of sondes: a battery powered sonde and a wire line powered sonde. FIG. 13 illustrates the sonde mounting of the present disclosure adapted for use with a wireline sonde.

In FIG. 13 the wire line is threaded through the drill string from the ground surface to the drill head in any known manner. Present drill head configurations provide for a wire routing path that allows the wireline to be connected to a sonde. This routing generally involves a strain relief plug 74, strain relief 76 and tapped hole 150, as illustrated in FIG. 13. The tapped hole 150 projects from one end of the main housing 100 into the cavity 102. When a battery powered sonde is used, there is no need for anything to project through this hole, so a plug 72 (shown in FIG. 4) is installed. However, when a wireline sonde is used, this plug 72 is removed and a similar plug (i.e. strain relief plug 74) is installed.

The strain relief plug 74 includes a cavity large enough for a strain relief 76 to be installed. The strain relief 76 is cylindrical and includes a through hole aligned with the axis of the outer cylindrical surface of the strain relief The through hole is sized to fit tightly over the outer diameter of a wire 25 projecting out of the wireline sonde. The wire 25 from the wireline sonde is routed through a hole 160 in 64 *a* or 64 *b*, then through a hole 162 in isolator 60, then through a slot 164 in main housing 100. (The slot 164 is also shown in FIG. 7B.) The wire 25 is routed from slot 164 through a threaded hole 150. Strain relief 76 is then slid over the wire and into the void in the strain relief plug 74.

Once these components are assembled, the strain relief plug 74 is assembled into the threaded hole 150 and tightened. The threaded hole 150 includes a larger threaded section and a smaller through hole section so that strain relief 76 can be inserted through the threaded diameter, but cannot pass through the smaller through hole section. Thus as the strain relief plug 74 is tightened, strain relief 76 is compressed thereby restricting the movement of the wire 25 and sealing the wireline to prevent transfer of fluid into cavity 102. In this manner the sonde housing assembly is adaptable to allow use of wireline sondes or battery powered sondes Another element that makes the sonde housing adaptable is the use of a threaded connection on each end of the main housing 100. Referring back to FIG. 6, the main housing 100 is shown as a one-piece design having three sections. The three sections may have standard API (American Petroleum Institute) threads on each end. The three sections of the main housing 100 include: a center section 130, a top end section 132 and a bottom end section 134. FIG. 7A illustrates how these three sections fit together.

The threaded connections of the top end section and the bottom end section 132 and 134 of the illustrated embodiment are female threaded connections. It is contemplated the threaded connections of the top and bottom end sections may also include male threaded connections. In general the threaded connection preferably include standard API tapered thread connection having a major diameter and a minor diameter.

The top end section 132 includes a projection 140 of length 141. Center section 130 includes a cylindrical cavity 142 of depth 143. The cavity depth 143 is deeper than the projection length 141 which results in a gap or void 136 as shown in FIG. 6. This void is utilized as a part of the fluid flow path. The bottom end section 134 has similar features including a projection 140' of length 141' and center section including a cavity 142 of depth 143. It is not necessary the projection 140 have a mating configuration to the cylindrical cavity 142. A portion of the projection 140 may be utilized to assist in proper orientation of the components, and is optional. One key aspect of this configuration is the resulting void 136 created by the cavity 142 in the center section 130 which is utilized as a part of the fluid flow path.

The complete fluid flow path through the main housing 100 in FIG. 6 as viewed from left to right, starts through the top end section 132 which will accept fluid from the drill string 10, as delivered through the rear adapter sub 18, as in FIG. 2. The fluid is transferred into the void 136 and then into drilled holes 138. Exiting the drilled holes 138, the fluid encounters the other void 136 and is directed through the bottom end section 134. With this construction, the location of the drilled holes 138 in the center section 130 is not affected by the dimensions of the threaded connections of either the top end section 132 or the bottom end section 134. Both sections are illustrated with female threads in FIGS. 6 and 7, but there is no restriction on the configuration selected. The threads could be any size, male or female.

The fluid flow advantages of this configuration are in the size of the drilled holes 138 and the flow transition required for the fluid to transfer into these holes. The void 136 provides the fluid with a gentle transition in contrast to 90 degree turns found in conventional configurations. The gentle transition provided by the voids thereby reduce fluid flow constrictions.

In addition, the size of the drilled holes 138 can be optimized easily and efficiently as the hole locations are not affected by the physical characteristics of the threaded connections. Thus, this configuration allows the center section to be constructed to maximize its strength while at the same time maximizing the fluid flow path provided.

The completed main housing 100 is thus constructed by manufacturing a top end section 132 a bottom end section 134 and a center section 130. The center section is constructed to provide a cavity 102 for mounting a sonde while at the same time provide fluid flow passages via drilled holes 138 and cavities 142. The end sections 132 and 134 are constructed with threaded connections and preferably joined to the center section 130 by welding.

One method of manufacturing the main housing involves the following:

1) machine holes 138 in housing section 130;
2) machine pockets 142 in both ends of housing section 130;
3) machine end pieces 1134 and 132 except for the thread connection;
4) leave overstock on outer diameters of parts 132, 134, and 130 for clean up machining;
5) slide end 140 of part 132 into pocket 142 and slide end 140 of part 134 into opposite pocket 142 of part 130;
6) clamp three pieces together to hold orientation;
7) performing welding operation in v-grooves generate at mating location of parts 132, 130, and 134;
8) post heat treatment;
   a) stress relieve assembly
   b) throughly harden assembly to Rc 28-32' and
9) post heat treat, machine the following geometric features:
   a) threaded ends
   b) outer diameter
   c) sonde pocket and related geometry An alternate method of manufacturing a sonde housing is illustrated in FIGS. 19A–19E. This method starts with a single piece of bar stock wherein the fluid transfer holes are drilled in step 1, shown in FIG. 19A. Step 2, shown in FIG. 19B involves plugging those fluid transfer holes in a manner that the plugs will become substantially integral with the bar stock material. This process may involve several optional methods. The method illustrated being to insert plugs that are larger than the holes such that they are press-fit into the holes. These plugs could then be further retained by heating the plugs nearly to the melting temperature to effectively bond them to the bar stock material. Many other techniques could be practiced. Step 3, shown in FIG. 19C involves machining threads and step 4, shown in FIG. 19D involves machining annular cylindrical voids with an outer diameter that exceeds the inner diameter of the threads such that the originally drilled fluid transfer holes are fluidly connected to the annular cylindrical voids extending outwardly from the threads. Step 5, shown in FIG. 19E involves machining the sonde cavity.

The embodiments of the present disclosure may be used in a variety of applications. For example, the sonde housing is designed to be utilized in multiple applications of drilling including: dirt boring, rock boring, sewer product installation, back reaming, percussive drilling, and other drilling applications.

In addition, it is obvious that many other modifications and variations of the present invention are possible in light of the above teachings. It is therefore to be understood that, within the scope of the appended claims, the invention may be practiced otherwise than as specifically described.

What is claimed is:

1. A sonde housing, comprising:

a) a main body having a first end and a second end, the main body defining:
   i) a plurality of fluid passages, each passage of the plurality of fluid passages discretely extending from the first end of the main body to the second end of the main body; and
   ii) a sonde cavity, the sonde cavity being isolated from the plurality of fluid passages; and
b) a first end piece coupled to the first end of the main body and a second end piece coupled to the second end of the main body, each of the first and second end pieces including a fluid passage in fluid communication with each of the passages of the plurality of fluid passages defined by the main body.

2. The sonde housing of claim 1, wherein the main body defines a central axis, the sonde cavity being offset from the central axis of the main body.

3. The sonde housing of claim 2, wherein each of the fluid passages defined by the main body are offset from the central axis of the main body.

4. The sonde housing of claim 1, wherein the fluid passages defined by the main body are parallel to one another.

5. The sonde housing of claim 1, wherein each of the fluid passages defined by the main body has a length, the entire length of each of the fluid passages being parallel to a central axis of the main body.

6. The sonde housing of claim 1, wherein a first void is defined between the first end of the main body and the first end piece, and a second void is defined between the second end of the main body and the second end piece, the voids being configured to provide a transition between the fluid passages of each of the first and second end pieces and the plurality of fluid passages defined by the main body.

7. The sonde housing of claim 1, wherein the cavity defined by the main body is configured to radially receive a sonde.

8. The sonde housing of claim 1, wherein the first and second end pieces are welded to the corresponding first and second ends of the main body.

9. The sonde housing of claim 1, wherein the first and second end pieces include threaded connections for coupling drilling components to each of the end pieces.

10. A sonde housing, comprising:

a) a cylindrical main body having a central axis extending between a first main body end and a second main body end, the central axis defining a plane that bisects the cylindrical main body into a first region and a second region, the cylindrical main body further defining:
   i) a plurality of fluid passages, each of the passages of the plurality of fluid passages being offset from the central axis of the cylindrical main body, each of the passages of the plurality of passages being located in only the first region of the main cylindrical body; and
   ii) a sonde cavity offset from the central axis of the cylindrical main body, the sonde cavity being located primarily in the second region of the main cylindrical body such that the sonde cavity is isolated from the plurality of fluid passages.

11. The sonde housing of claim 10, wherein each passage of the plurality of fluid passages discretely extends from the first end of the cylindrical main body to the second end of the cylindrical main body.

12. The sonde housing of claim 10, wherein each of the fluid passages defined by the cylindrical main body has a length, the entire length of each of the fluid passages being parallel to the central axis of the cylindrical main body.

13. The sonde housing of claim 10, further including a first end piece coupled to the first end of the cylindrical main body and a second end piece coupled to the second end of the cylindrical main body, each of the first and second end pieces including a fluid passage in fluid communication with each of the passages of the plurality of fluid passages defined by the main body.

14. The sonde housing of claim 13, wherein a first void is defined between the first end of the cylindrical main body and the first end piece, and a second void is defined between the second end of the cylindrical main body and the second end piece, the voids being configured to provide a transition between the fluid passages of each of the first and second end pieces and the plurality of fluid passages defined by the cylindrical main body.

15. The sonde housing of claim 13, wherein the first and second end pieces are welded to the corresponding first and second ends of the cylindrical main body.

16. The sonde housing of claim 10, wherein the sonde cavity defined by the cylindrical main body is configured to radially receive a sonde.

17. The sonde housing of claim 10, wherein the cylindrical main body has no fluid passages located in the second region at which the sonde cavity is located.

* * * * *